US009211005B2

(12) United States Patent
Smith

(10) Patent No.: US 9,211,005 B2
(45) Date of Patent: Dec. 15, 2015

(54) STORAGE SYSTEMS

(76) Inventor: Sharon Lynne Smith, North Myrtle Beach, SC (US)

( * ) Notice: Subject to any disclaimer, the term of this patent is extended or adjusted under 35 U.S.C. 154(b) by 271 days.

(21) Appl. No.: 12/940,504

(22) Filed: Nov. 5, 2010

(65) Prior Publication Data

US 2011/0110075 A1 May 12, 2011

Related U.S. Application Data

(60) Provisional application No. 61/258,898, filed on Nov. 6, 2009.

(51) Int. Cl.

| | |
|---|---|
| ***A47B 81/00*** | (2006.01) |
| ***A47B 67/04*** | (2006.01) |
| ***A47B 81/06*** | (2006.01) |
| ***F21S 6/00*** | (2006.01) |
| ***F21V 27/00*** | (2006.01) |

(52) U.S. Cl.

CPC ..... *A47B 81/00* (2013.01); *A47B 67/04* (2013.01); *A47B 81/06* (2013.01); *F21S 6/005* (2013.01); *F21V 27/00* (2013.01); *A47B 2220/0077* (2013.01)

(58) Field of Classification Search

CPC ..... A47B 13/16; A47B 96/20; F21V 33/0012

USPC ..... 362/223.1–223.6, 127; 312/223.1–223.6

See application file for complete search history.

(56) References Cited

U.S. PATENT DOCUMENTS

| | | | | |
|---|---|---|---|---|
| 1,693,620 | A * | 12/1928 | Silverman | 362/132 |
| 1,748,601 | A * | 2/1930 | Gottlieb | 362/387 |
| 2,232,580 | A * | 2/1941 | Wickemeyer | 191/12.4 |
| 3,684,344 | A * | 8/1972 | Gilinger | 312/223.5 |
| 2005/0194875 | A1* | 9/2005 | Reed et al. | 312/405.1 |
| 2006/0238085 | A1* | 10/2006 | Greenberg | 312/306 |
| 2006/0261714 | A1* | 11/2006 | Hazzard | 312/319.8 |
| 2008/0169734 | A1* | 7/2008 | Bartels | 312/7.2 |
| 2009/0218918 | A1* | 9/2009 | Wilson et al. | 312/7.2 |

* cited by examiner

*Primary Examiner* — William Carter

(74) *Attorney, Agent, or Firm* — McGuireWoods LLP

(57) ABSTRACT

A furniture article that comprises a furniture housing which is configured to rest on a surface, and a cord-retractor that is configured to supply power from a wall outlet to an outlet located in or on the furniture housing.

6 Claims, 12 Drawing Sheets

STORAGE SYSTEMS

CROSS REFERENCE TO PRIOR APPLICATIONS

This application claims the benefit from U.S. Provisional Application No. 61/258,898 filed on Nov. 6, 2009, which is hereby incorporated herein by reference for all purposes as if fully set forth herein.

FIELD OF THE DISCLOSURE

The disclosure relates to furniture articles, including, lamps, wall-mount storages, casegood storages, and the like.

BACKGROUND OF THE DISCLOSURE

Today's homes and offices are becoming evermore cluttered with personal items and dangerous due to loose power cords. For example, furniture articles, such as lamps, are frequently positioned in locations where an entirety of the power cord is not necessary to plug the cord into a wall outlet, thereby leaving the excess power cord on the floor, resulting in a safety hazard. Other furniture articles, such as television stands, take up large amounts of space, in addition to generally having many power cords dangling loosely or piled up on the floor behind the stands.

The present disclosure provides furniture articles, including, lamps, wall-mount storages, and casegood storages that reduce clutter, improve safety, and maximize useable space.

SUMMARY OF THE DISCLOSURE

According to an aspect of the disclosure, a furniture article is disclosed. The furniture article comprises: a furniture housing that is configured to rest on a surface; and a cord-retractor that is configured to supply power from a wall outlet to an outlet located in or on the furniture housing.

The furniture article may further comprise: a light emitting element that is configured to irradiate light; and/or a panel that encloses a cavity defined by the furniture housing. The furniture housing may comprise: a housing base that includes the cord-retractor; and/or an opening that is configured to allow the power cord to pass therethrough. The furniture article may comprise a lamp. The lamp may include a table lamp or a floor lamp.

The furniture article may further comprise: a panel that encloses a cavity defined by the furniture housing; and/or a drawer that is located in the furniture housing and substantially concealed by the panel when the panel is in a closed position. The furniture housing may comprise: a housing base that includes the cord-retractor; and/or an opening that is configured to allow the power cord to pass therethrough. The drawer may comprise clear injection molded plastic. The panel may comprise a built-in unit that is configured to receive at least one of: eye glasses; a cell phone; a wallet; a purse; a magazine; an iPod; an iPad; or a set of keys. The panel may comprise at least one of: an eye glass unit that is configured to receive eye glasses; a magazine unit that is configured to receive a magazine or a document; a cell phone unit that is configured to receive a cell phone; a wallet unit that is configured to receive a wallet; and a key unit that is configured to receive a set of keys.

According to a further aspect of the disclosure, a wall-mount flat screen television storage is disclosed that has a housing which defines a cavity for holding a flat screen television. The storage comprises: a wall insert portion that is configured to be placed in a building wall; a frame portion that is configured to rest against a surface of the building wall; and a panel that is configured to enclose the cavity and substantially entirely conceal an interior of the cavity, wherein the panel is further configured to receive and hold a decorative feature. The storage may further comprise a television mount bracket that holds the television.

According to a still further aspect of the disclosure, a furniture article is disclosed that comprises: a furniture housing that is configured to rest on a surface; a panel that encloses a cavity defined by the furniture housing; and a drawer that is located in the furniture housing and substantially concealed by the panel when the panel is in a closed position. The drawer may comprise clear injection molded plastic. The panel may comprise a built-in unit that is configured to receive at least one of: eye glasses; a cell phone; a wallet; a purse; a magazine; an iPod; an iPad; or a set of keys. The panel may comprise at least one of: an eye glass unit that is configured to receive eye glasses; a magazine unit that is configured to receive a magazine or a document; a cell phone unit that is configured to receive a cell phone; a wallet unit that is configured to receive a wallet; and a key unit that is configured to receive a set of keys. The furniture article may further comprise a mirror. The mirror may comprise a soft light.

Additional features, advantages, and embodiments of the disclosure may be set forth or apparent from consideration of the following detailed description and drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced.

DETAILED DESCRIPTION OF THE DISCLOSURE

Figure 1:
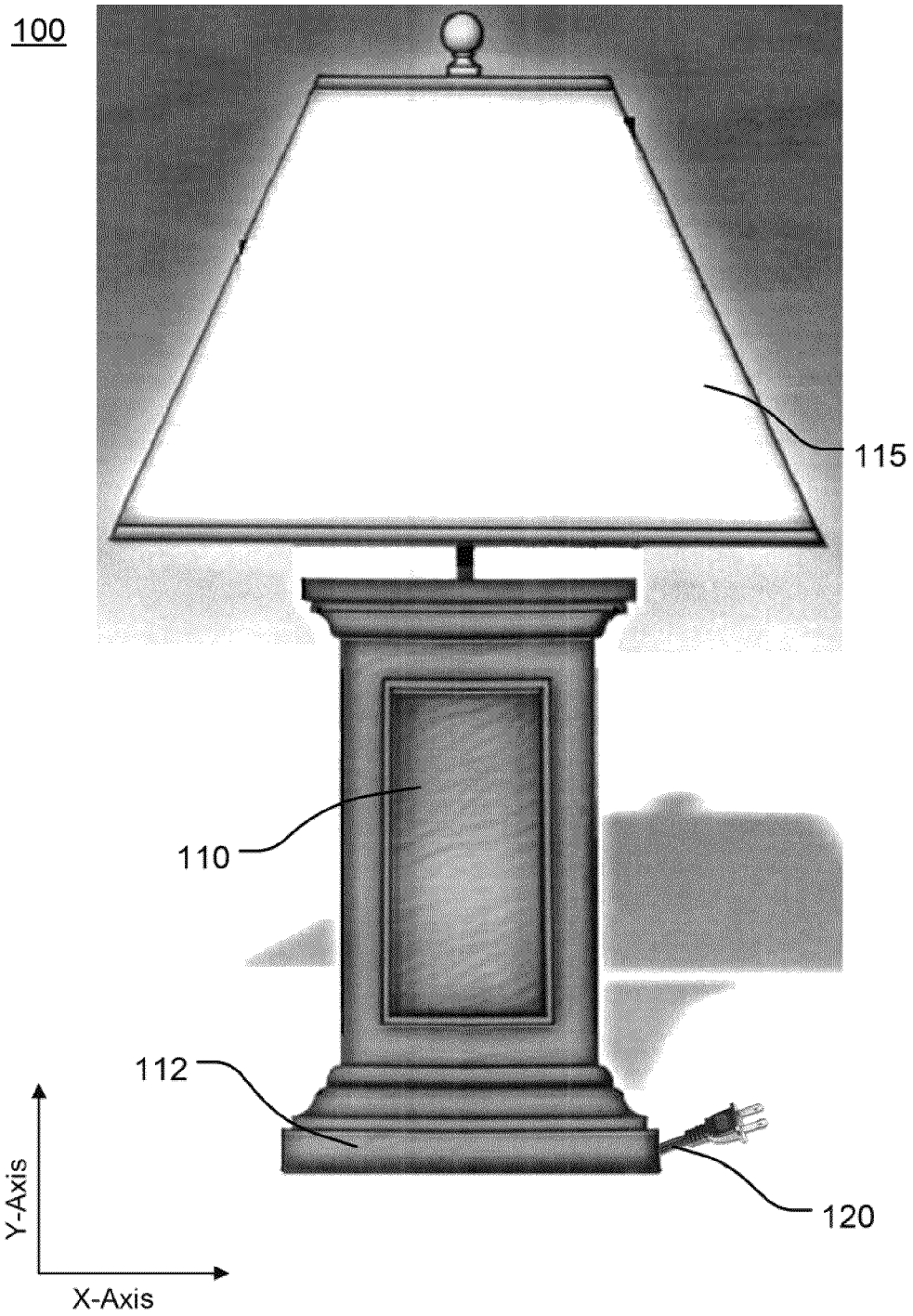
FIG. 1 shows an example of a lamp with a retractable cord, constructed according to principles of the disclosure.

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

A "computer", as used in this disclosure, means any machine, device, circuit, component, or module, or any system of machines, devices, circuits, components, modules, or the like, which are capable of manipulating data according to one or more instructions, such as, for example, without limitation, a programmable logic controller (PLC), a motion controller, a processor, a microprocessor, a central processing unit, a general purpose computer, a super computer, a personal computer, a laptop computer, a palmtop computer, a notebook computer, a desktop computer, a workstation computer, a server, or the like, or an array of processors, microprocessors, central processing units, general purpose computers, super computers, personal computers, laptop computers, palmtop computers, notebook computers, desktop computers, workstation computers, servers, or the like. Further, the computer may include an electronic device configured to communicate over a communication link. The electronic device may include, for example, but is not limited to, a mobile telephone, a smart telephone, a cellular telephone device, a satellite telephone device, a cordless telephone, a software defined radio (SDR), a two-way radio, a personal data assistant (PDA), a mobile computer, a stationary computer, mobile station, a game console, a game controller, user equipment, or the like.

A "network," as used in this disclosure, means an arrangement of two or more communication links. A network may include, for example, the Internet, a local area network (LAN), a wide area network (WAN), a metropolitan area network (MAN), a personal area network (PAN), a campus area network, a corporate area network, a global area network (GAN), a broadband area network (BAN), any combination of the foregoing, or the like. The network may be configured to communicate data via a wireless and/or a wired communication medium. The network may include any one or more of the following topologies, including, for example, a point-to-point topology, a field bus topology, a bus topology, a linear bus topology, a distributed bus topology, a star topology, an extended star topology, a distributed star topology, a ring topology, a mesh topology, a tree topology, or the like.

A "communication link", as used in this disclosure, means a wired and/or wireless medium that conveys data or information between at least two points. The wired or wireless medium may include, for example, a metallic conductor link, a radio frequency (RF) communication link, an Infrared (IR) communication link, an optical communication link, or the like, without limitation. The RF communication link may include, for example, WiFi, WiMAX, IEEE 802.11, DECT, 0G, 1G, 2G, 3G or 4G cellular standards, Bluetooth, or the like.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

FIG. 1 shows an example of a lamp 100 that is constructed according to principles of the disclosure. The lamp 100 includes a lamp (or furniture) housing 110, a lamp shade 115 and a retractable power cord 120. The lamp 100 may include a power cord opening (not shown) through which the power cord 120 passes. The lamp housing 110 may include a housing base 112, which is configured to rest on a surface, such as, for example, a table, a floor, or the like. The power cord opening may include a guide (not shown), which allows the power cord 120 to be extracted from the lamp 100 (or retracted into the lamp 100) with substantially no friction. The guide may be located, for example, in a bottom portion of the housing base 112. The guide may include, for example, a ring, linear bearings, or the like.

According to the principles of the disclosure, the lamp 100 includes the power cord 120 in the lamp housing 110, leaving external to the lamp 100 only the length of the power cord 120 that is needed to plug the power cord 120 to a nearest power outlet (not shown). By housing the excess portion of the power cord 120 in the lamp housing 110, a safer environment may be provided around the lamp 100, reducing a likelihood that someone will trip on the power cord 120, or that the power cord 120 may be pinched or cut, or the like. The lamp 100 may be a table lamp, a floor lamp, a wall lamp, or the like.

Alternatively (or additionally) the lamp 100 may include a cavity and a panel (not shown) in the lamp housing 110. The panel may be configured to open and close. The panel may include, for example, a trap door that is located in the housing base 112, which may opened so that a user may manually place an unneeded portion of the power cord 120 in the housing base 112. The cavity may be configured to house a portion of, or the entire length of the power cord 120. The panel may include an opening to allow the power cord 120 to pass therethrough.

Figure 2:
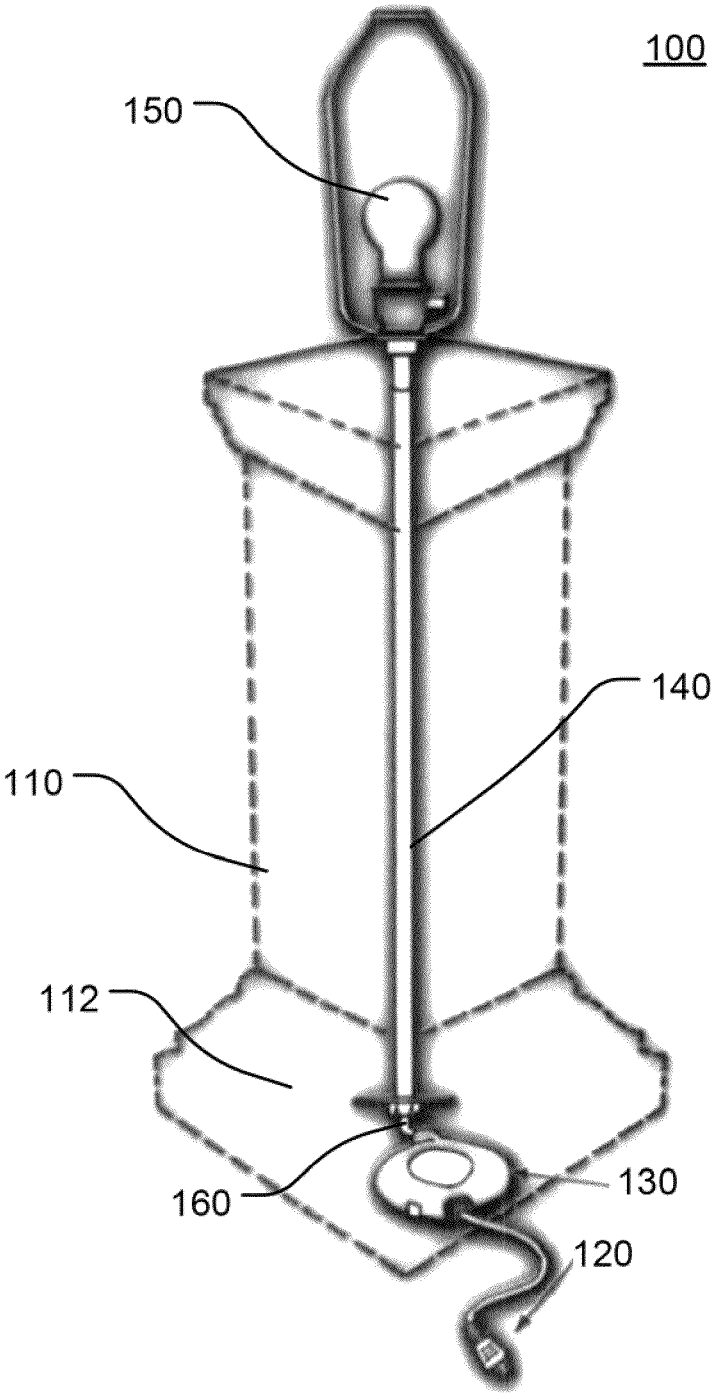
FIG. 2 shows a schematic view of the lamp of FIG. 1 having a cord-retractor, constructed according to principles of the disclosure.

FIG. 2 shows a schematic view of the lamp 100, including a cord-retractor 130. The lamp 100 includes a light emitting element 150, a power line 140, and the cord-retractor 130. The light emitting element 150 is configured to irradiate light to illuminate an ambient space. The cord-retractor 130 includes the power cord 120 and a power supply line 160. The power line 140 may be coupled the power supply line 160 using known methods, including, for example, splicing and/or soldering the power line 140 to the power supply line 160, using connector caps, or the like. Alternatively, the power supply line 160 may be connected directly to the light emitting element 150.

The cord-retractor 130 may include a spring mechanism (not shown) and a stop mechanism (not shown). The spring mechanism may be pretensioned so that the power cord 120 may be retracted substantially entirely into the housing of the cord-retractor 130 by a retracting force exerted by the spring on, for example, a pulley (not shown) in the cord-retractor 130. The stop mechanism may be configured, for example, to stop retraction (or extraction) of the power cord 120 at a plurality of discrete points along the length of the power cord 120.

Figure 3:
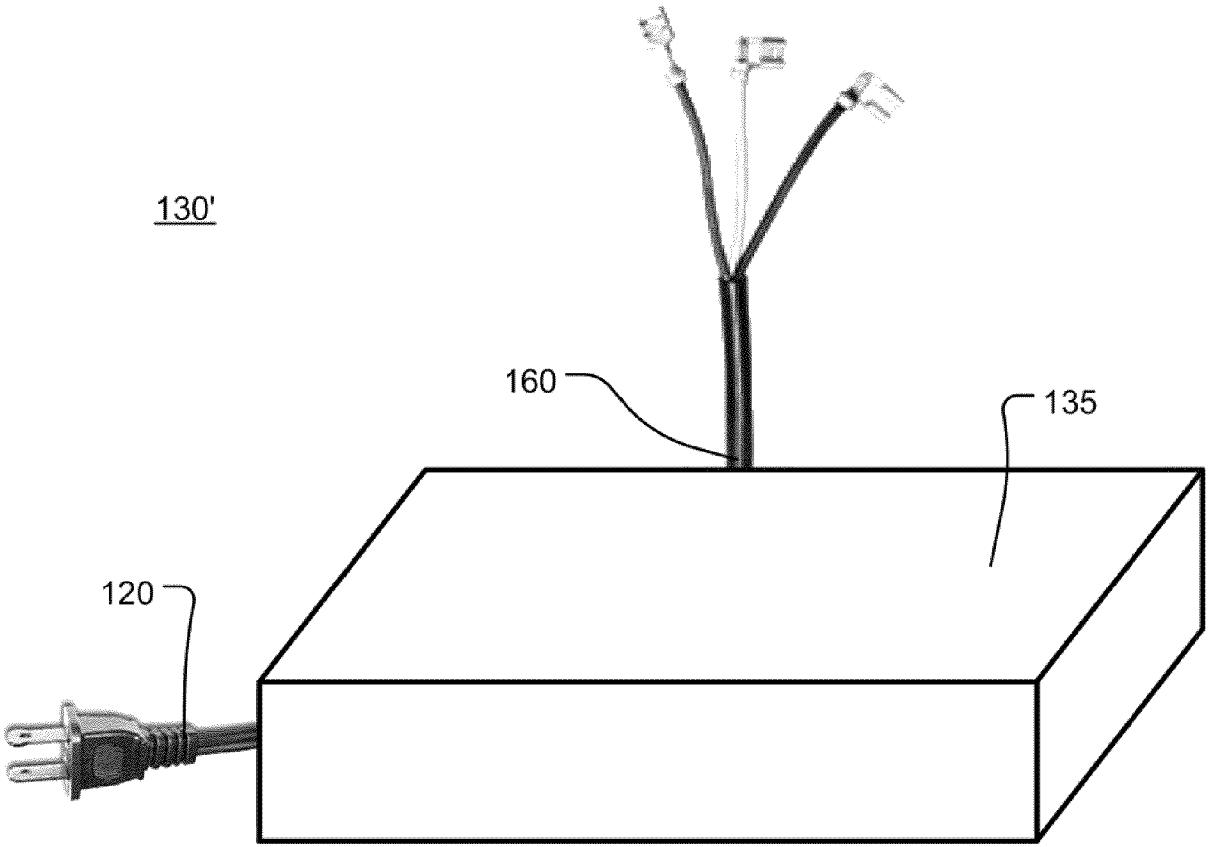
FIG. 3 shows an example of a cord-retractor, constructed according to principles of the disclosure.

FIG. 3 shows an example of a cord-retractor 130', constructed according to principles of the disclosure. The cord-retractor 130' includes the power cord 120, the power supply line 160 and a housing 135. The cord-retractor 130' is configured to supply power from, for example, a wall outlet to an electric outlet, fixture or appliance via the power supply line 160. The housing 135 may be shaped and sized to a desired application. The housing 135 may include a guide (not shown) to allow the power cord 120 to be extracted from the housing 135 (or retracted into the housing 135) with substantially no friction. The guide may include, for example, a ring, linear bearings, or the like.

For example, in the lamp base 120 (shown in FIG. 1), which is substantially square in the x-z plane, the housing 135 may be constructed in the shape of a rectangle (shown in FIG. 3). The z-axis is perpendicular to the x-axis and y-axis, shown in FIG. 1. Alternatively, in a lamp base 120 that is substantially circular in the x-z plane (not shown), the housing 135 may be constructed in the shape of a cylinder (not shown).

Figure 4:
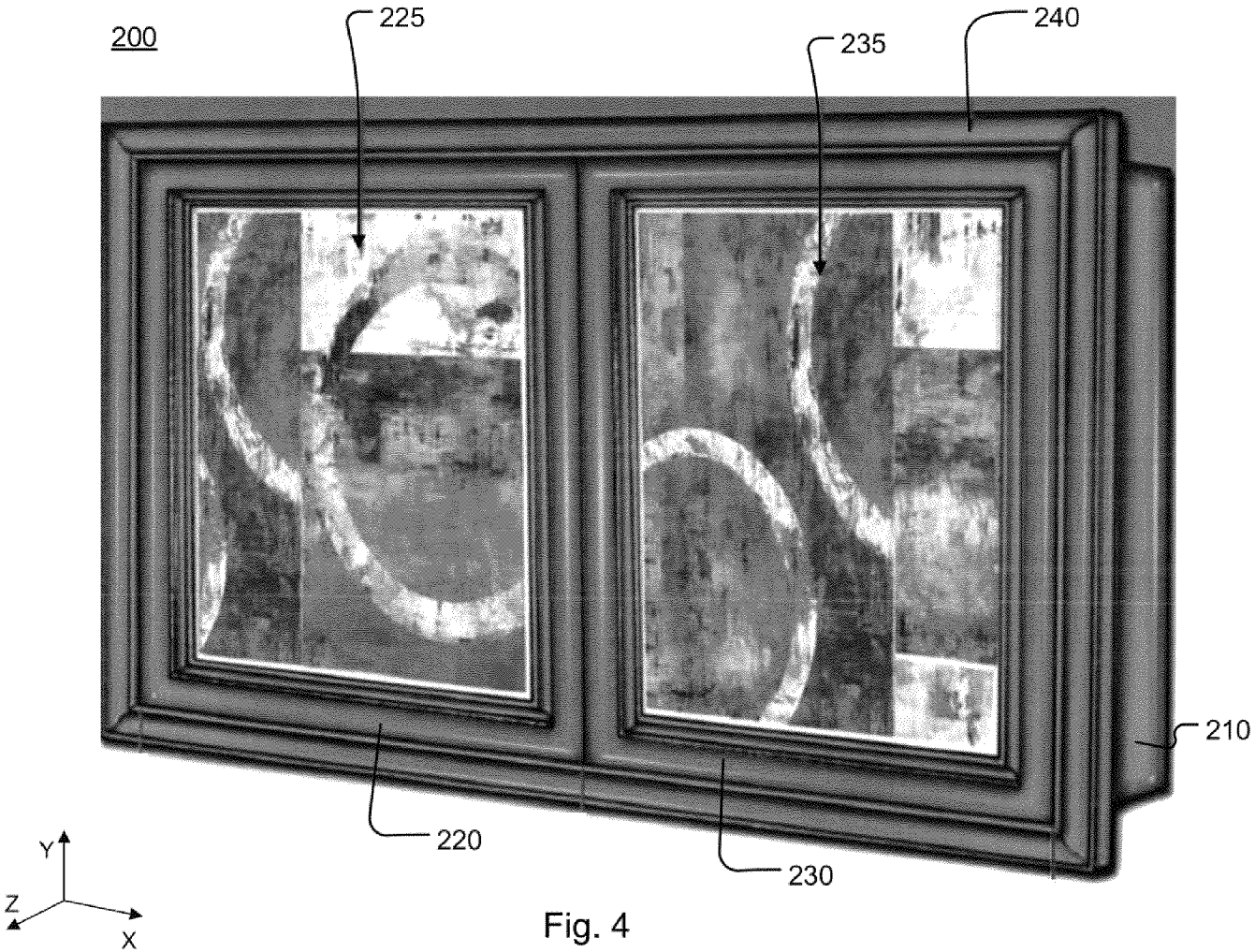
FIG. 4 shows an example of a wall-mount flat-screen television (WMTV) storage, constructed according to principles of the disclosure.

FIG. 4 shows an example of a wall-mount flat-screen television (WMTV) storage 200, which is constructed according to principles of the disclosure. The WMTV storage 200 has a furniture housing that includes a wall insert portion 240, a frame portion 210, and a pair of panels 220, 230. Although shown as comprising a pair of panels 220, 230, the WMTV storage 200 may, instead, include a single panel, or more than three panels. The WMTV storage 200 may further include one or more power surge protection outlets (not shown), cable TV outlets (not shown), satellite TV outlets (not shown), antenna outlets (not shown), fiber-optic outlets (not shown), data line outlets (not shown), or the like.

The wall insert portion 240 may have smaller dimensions along the x-axis and y-axis than the x-axis and y-axis dimensions, respectively, of the frame portion 210. The wall insert portion 240 is constructed to be inserted into an opening in a wall (not shown) of, for example, a residential or commercial building (not shown). The frame portion 210 may be configured to rest against a surface of the wall, thereby facilitating proper alignment of the WMTV storage 200 in the x-y plane. The wall insert portion 240 may include fasteners (not shown) for securing the wall insert portion 240 to, for example, joists, studs, or the like, in the wall.

Each of the panels 220, 230 may be configured to receive and hold a decorative feature, such as, for example, a mirror, a glass pane, a poster, a photograph, a print, a portrait, a painting, an etching, a canvas, or the like. The panels 220, 230 may be configured to open and close manually or automatically under the control of a controller (not shown), which may include a computer (not shown). In this regard, the WMTV storage 200 may include one or more actuators (not shown) that move the panels 220, 230 along the y-axis and/or x-axis, or that rotate the panels 220, 230 about the y-axis or about the x-axis.

Figure 5:
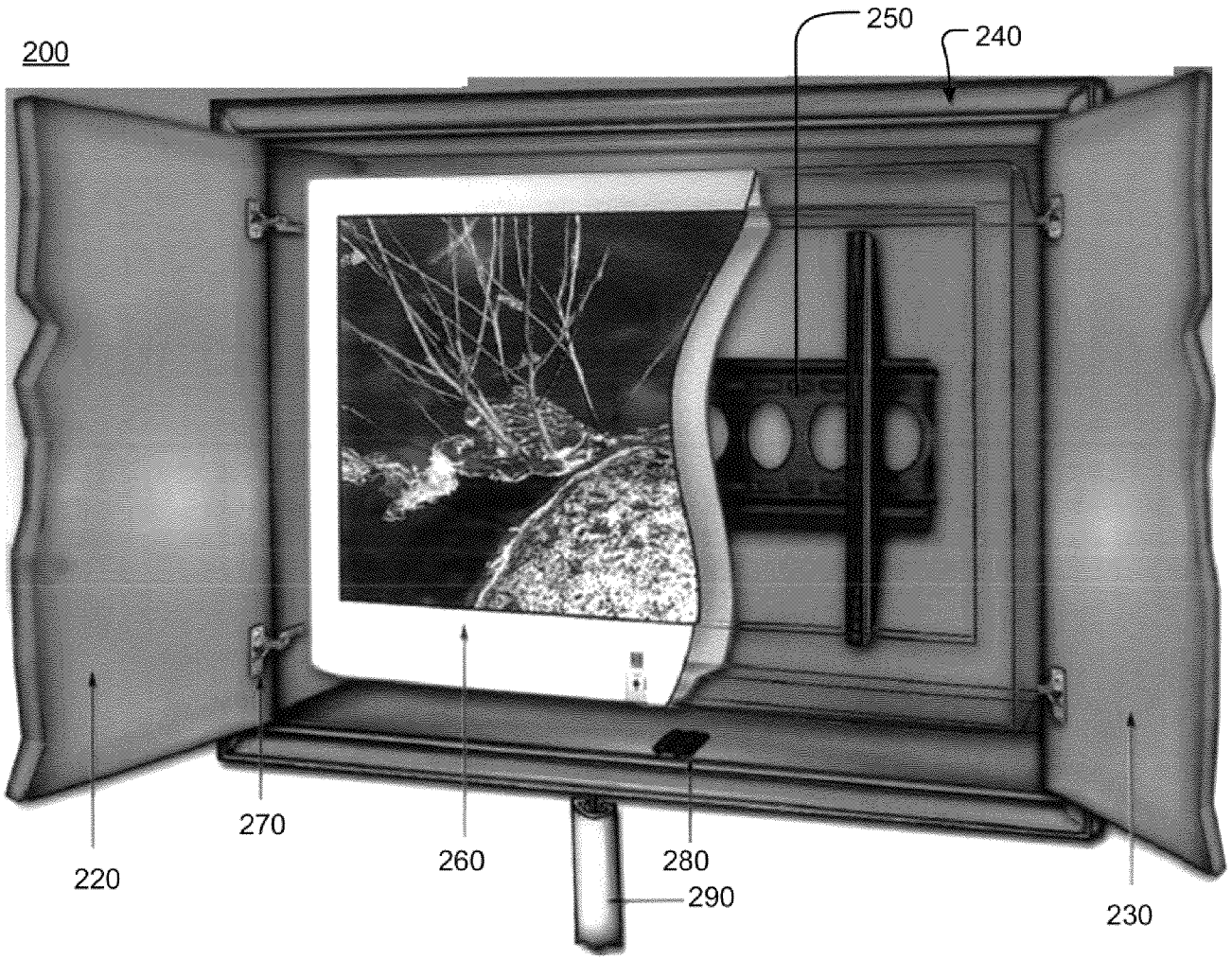
FIG. 5 shows the WMTV storage of FIG. 4 with a pair of panels in an open configuration.

FIG. 5 shows the WMTV storage 200 with the panels 220, 230 in an open configuration. In this example, the WMTV storage 200 includes a plurality of hinges 270 (for example, a 170° concealed hinge, or the like) for rotateally supporting the panels 220, 230, and a double magnetic touch latch 280 for engaging and holding the panels 220, 230 in a closed position (shown in FIG. 4). The WMTV storage 200 may further include a flat-screen television mounting bracket 250 on which a flat screen television (TV) 260 may be mounted. The mounting bracket 250 may be configured to extend the TV 260 out of the WMTV storage 200 along the z-axis. The mounting bracket 250 may include an actuator (not shown) for moving the TV 260 under the control of the controller (not shown). The WMTV storage 200 may be supplied with electric power, data signals, control signals, and the like, via a wiring harness 290.

The WMTV storage 200 is configured to effectively house, for example, a flat screen TV with minimal space requirements. The WMTV storage 200 may be mounted inside a wall, for example, between wall studs, or mounted on an existing wall space.

Figure 6:
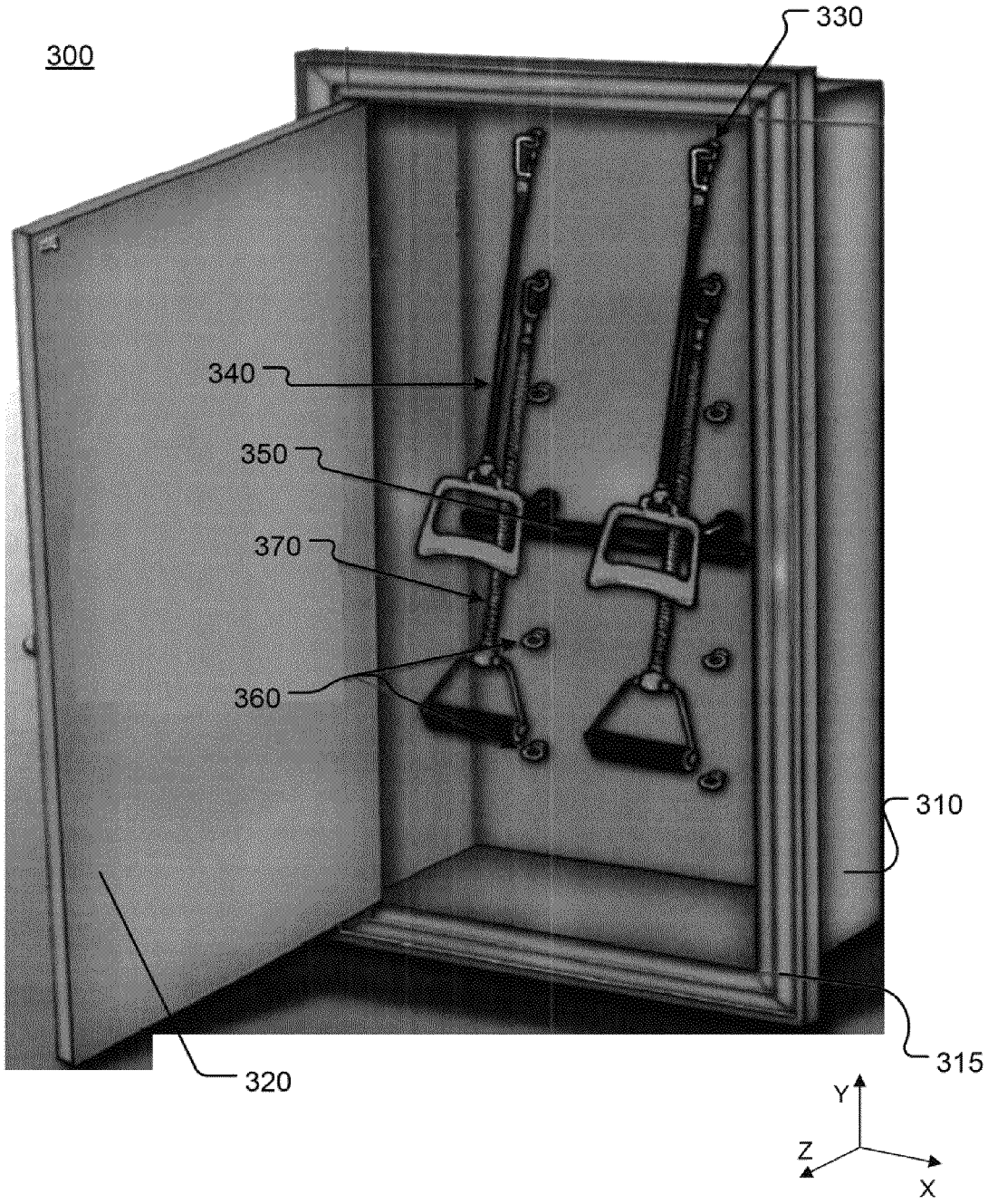
FIG. 6 shows an example of a wall-mount exercise equipment storage, constructed according to principles of the disclosure.

FIG. 6 shows an example of a wall-mount exercise equipment (WMEE) storage 300, which is constructed according to the principles of the disclosure. The WMEE storage 300 has a furniture housing that includes a wall insert portion 310 and a frame portion 315. The WMEE storage 300 may include a panel 320, a hand support 350, and a plurality of fasteners 360. The hand support 350 may include, for example, a round metal pole for ballet, and the fasteners 360 may each include, for example, an eye-hook. Exercise equipment 340, such as, for example, detachable bungee pulley 340, detachable spring pulley 370, or the like, may be attached to the fasteners 360.

The wall insert portion 310 may have smaller dimensions along the x-axis and y-axis than the x-axis and y-axis dimensions, respectively, of the frame portion 315. The wall insert portion 310 is constructed to be inserted into an opening in a wall (not shown) of, for example, a residential or commercial building (not shown). The frame portion 315 may be configured to rest against a surface of the wall, thereby facilitating proper alignment of the WMEE storage 300 in the x-y plane. The wall insert portion 310 may include fasteners (not shown) for securing the wall insert portion 310 to, for example, joists, studs, or the like, in the wall.

The panel 320 may be configured to receive and hold a decorative feature, such as, for example, a mirror, a glass pane, a poster, a photograph, a print, a portrait, a painting, an etching, a canvas, or the like. The panel 320 may be configured to open and close manually or automatically under the control of the controller (not shown). In this regard, the WMEE storage 300 may include an actuator (not shown) that operates under the control of the controller to move the panel 320 along the y-axis and/or x-axis, or to rotate the panel 320 about the y-axis or about the x-axis.

The WMEE storage 300 is configured to effectively house, for example, workout equipment, with minimal space requirements. The WMEE storage 300 may be mounted inside a wall, for example, between wall studs, or mounted on an existing wall space.

Figure 7:
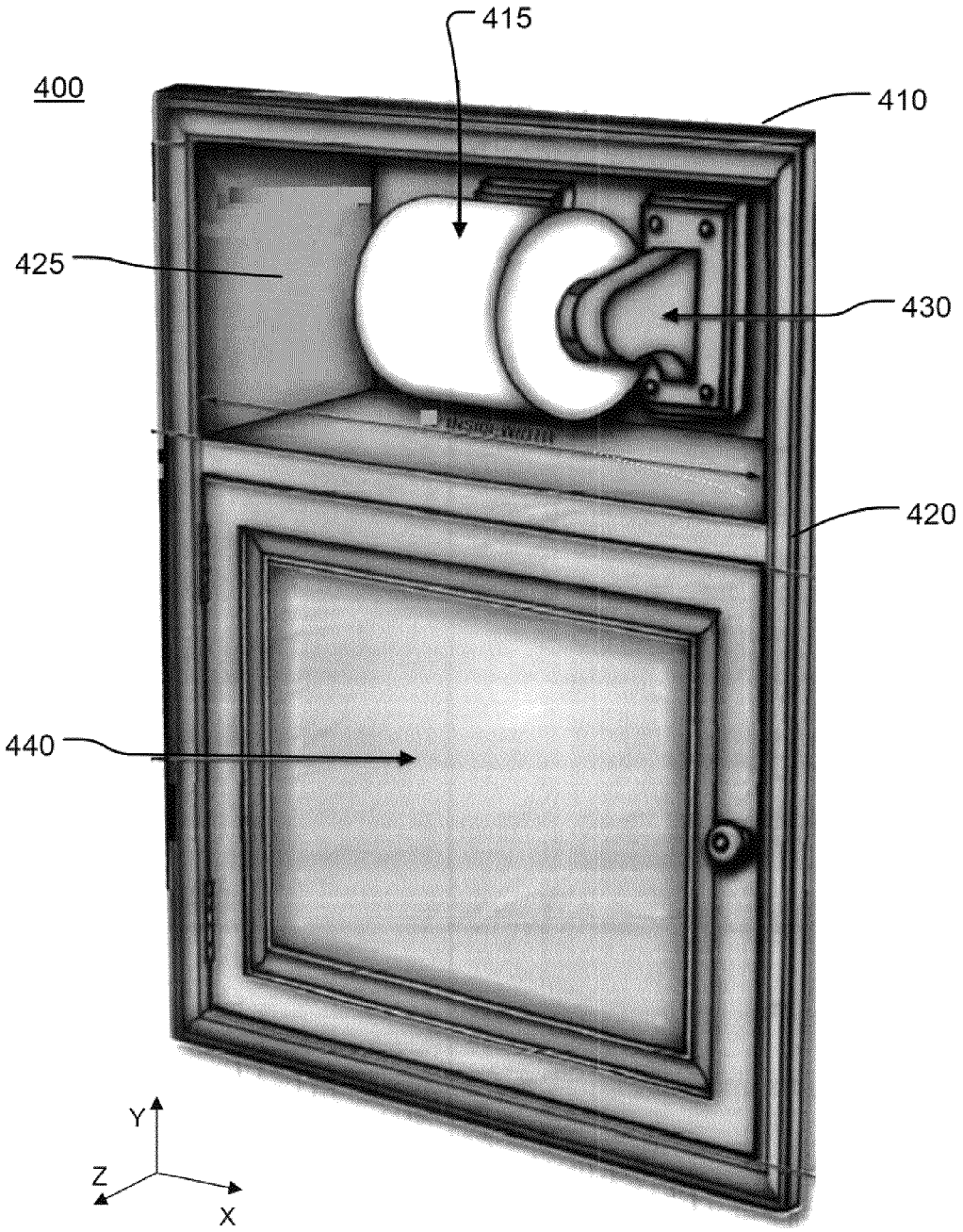
FIG. 7 shows an example of a bath tissue storage, constructed according to principles of the disclosure.
Figure 8:
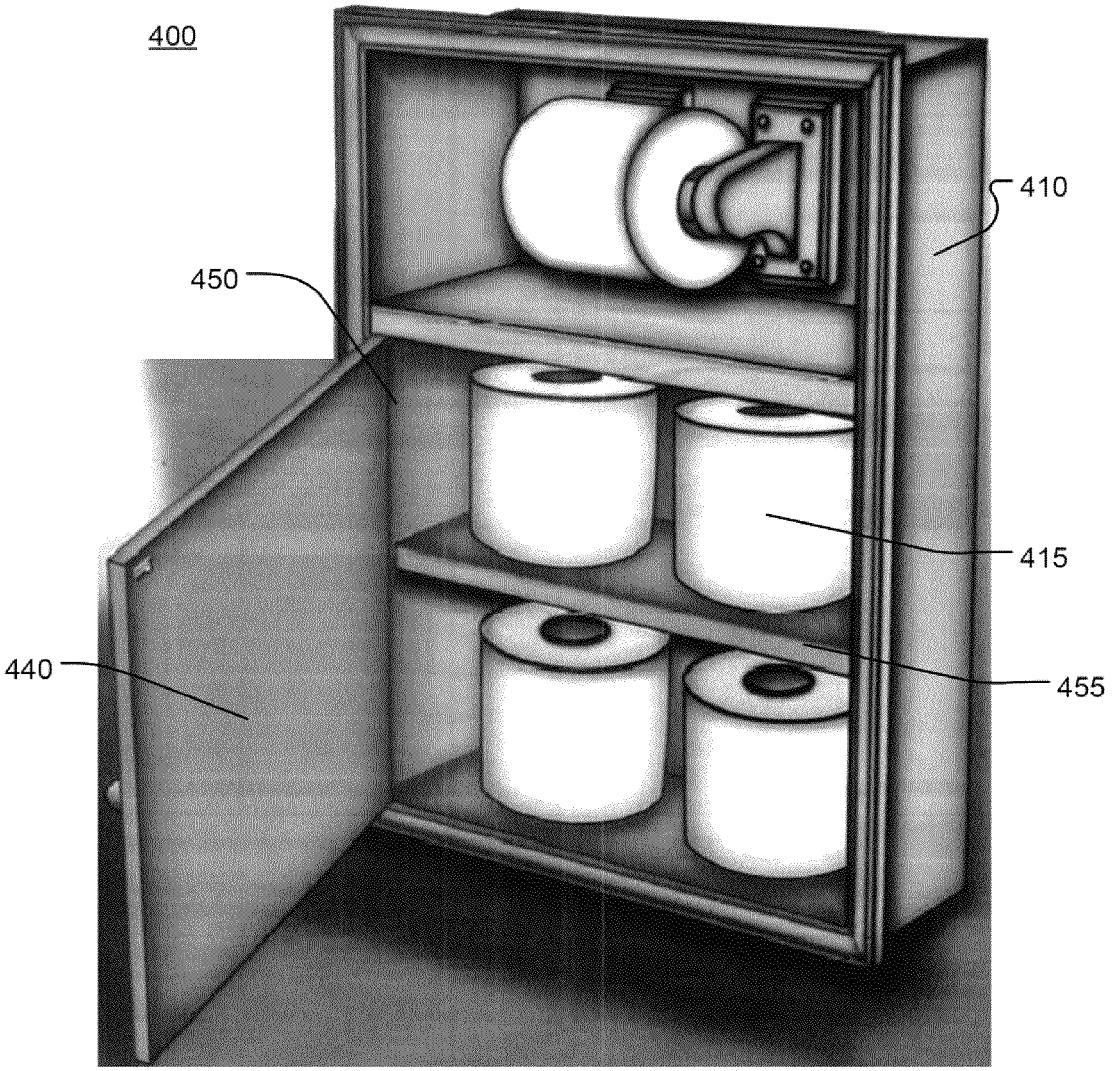
FIG. 8 shows the bath tissue storage of FIG. 7 with a panel in an open configuration.

FIGS. 7 and 8 show an example of a bath tissue (BT) storage 400 with a panel 430 in a closed configuration and an open configuration, respectively, constructed according to principles of the disclosure. The BT storage 400 has a furniture housing that includes a wall insert portion 410 and a frame portion 420. The BT storage 400 may include an upper cavity 425, a lower cavity 450, a toilet paper holder 430 for holding a roll of toilet paper 415, and a panel 440 for enclosing the lower cavity 450. One or more shelves 455 may be adjustably mounted in the lower cavity 450.

The wall insert portion 410 may have smaller dimensions along the x-axis and y-axis than the x-axis and y-axis dimensions, respectively, of the frame portion 420. The wall insert portion 410 is constructed to be inserted into an opening in a wall (not shown) of, for example, a residential or commercial building (not shown). The frame portion 420 may be configured to rest against a surface of the wall, thereby facilitating proper alignment of the BT storage 400 in the x-y plane. The wall insert portion 410 may include fasteners (not shown) for securing the wall insert portion 410 to, for example, joists, studs, or the like, in the wall.

The panel 440 may be configured to receive and hold a decorative feature, such as, for example, a mirror, a glass pane, a poster, a photograph, a print, a portrait, a painting, an etching, a canvas, or the like. The panel 440 may be configured to open and close manually or automatically under the control of the controller. In this regard, the BT storage 400 may include an actuator (not shown) that operates under the control of the controller to move the panel 440 along the y-axis and/or x-axis, or to rotate the panel 440 about the y-axis or about the x-axis.

The BT storage 400 is configured to effectively house personal items, such as, for example, toilet paper 415 with minimal space requirements. The BT storage 400 may be mounted inside a wall, for example, between wall studs, or mounted on an existing wall space.

Figure 9:
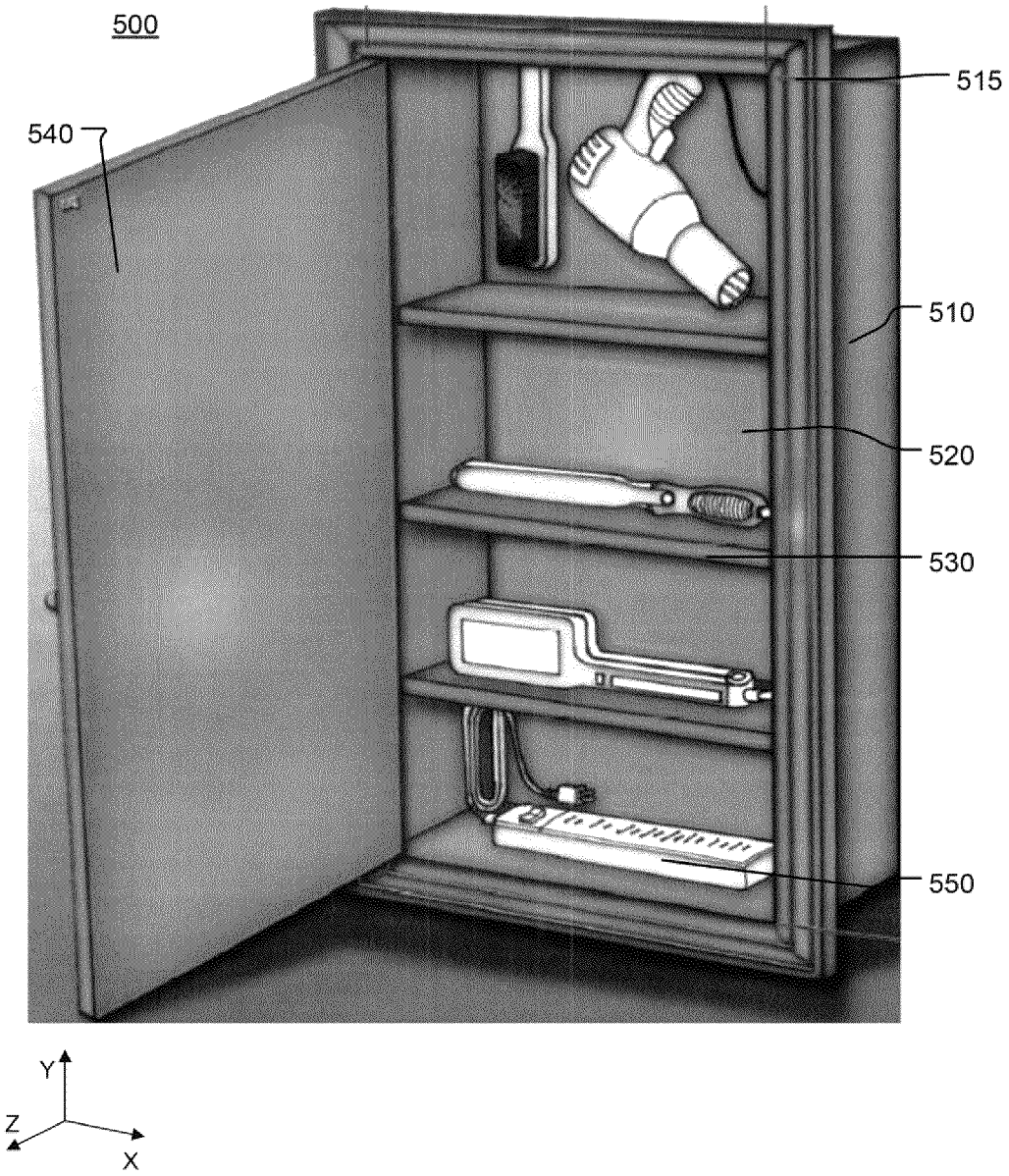
FIG. 9 shows an example of a hair accessory storage, constructed according to principles of the disclosure.

FIG. 9 shows an example of a hair accessory (HA) storage 500, which is constructed according to principles of the disclosure. The HA storage 500 includes a wall insert portion 510 and a frame portion 515. The HA storage 500 includes a cavity 520 and a panel 540. The HA storage 500 may include one or more shelves 530, which may be adjustably mounted in the cavity 520. The HA storage 500 may further include a power surge protection power supply 550, which may be integrated with the HA storage 500.

The wall insert portion 510 may have smaller dimensions along the x-axis and y-axis than the x-axis and y-axis dimensions, respectively, of the frame portion 515. The wall insert portion 510 is constructed to be inserted into an opening in a wall (not shown) of, for example, a residential or commercial building (not shown). The frame portion 515 may be configured to rest against a surface of the wall, thereby facilitating proper alignment of the HA storage 500 in the x-y plane. The wall insert portion 510 may include fasteners (not shown) for securing the wall insert portion 510 to, for example, joists, studs, or the like, in the wall.

The panel 540 may be configured to receive and hold a decorative feature, such as, for example, a mirror, a glass pane, a poster, a photograph, a print, a portrait, a painting, an etching, a canvas, or the like. The panel 540 may be configured to open and close manually or automatically under the control of the controller. In this regard, the HA storage 500 may include an actuator (not shown) that operates under the control of the controller to move the panel 540 along the y-axis and/or x-axis, or to rotate the panel 540 about the y-axis or about the x-axis.

The HA storage 500 is configured to effectively house, for example, hair accessories with minimal space requirements. The HA storage 500 may be mounted inside a wall, for example, between wall studs, or mounted on an existing wall space.

Figure 10:
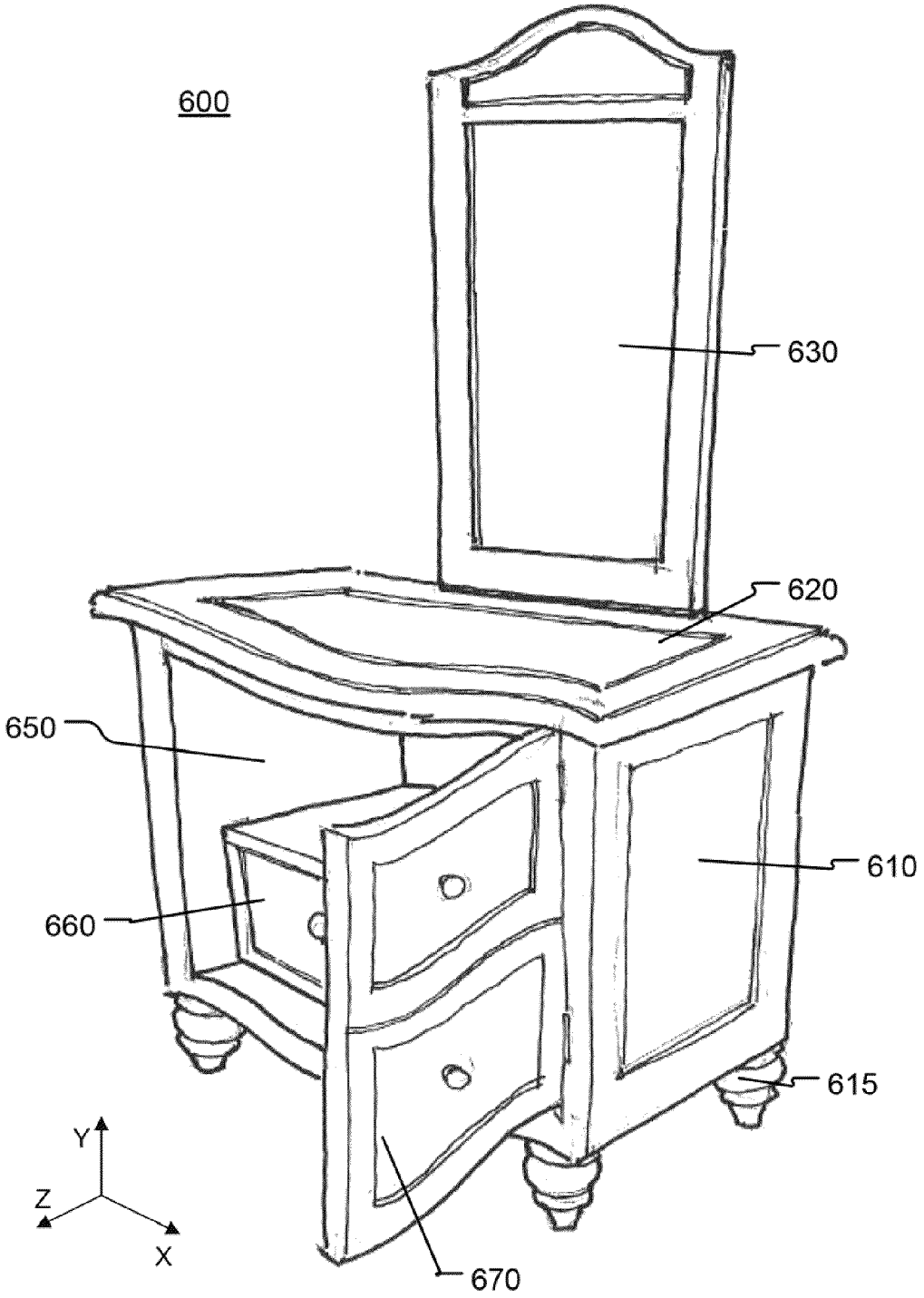
FIG. 10 shows an example a casegood storage, constructed according to principles of the disclosure.

FIG. 10 shows an example a casegood storage 600, which is constructed according to principles of the disclosure. The casegood storage 600 includes a furniture housing 610, a mirror 630, and a panel 670. The mirror 630 may include, for example, soft lighting. The furniture housing 610 may include a bottom, a plurality of walls and a top. A plurality of legs 615 may be attached to, or integrally formed with the bottom of the furniture housing 610. An insert 620 may be provided on the top of the furniture housing 610. The insert 620 may include, for example, a panel made from glass, metal, rubber, leather, plastic, paper, cloth, or the like.

The furniture housing 610 defines a storage cavity 650, which may include one or more drawers 660. The storage cavity 650 may be enclosed by the panel 670.

The furniture housing 610 may include one or more electric outlets (not shown) in the cavity 650 to accommodate a cell phone charger, an iPod charger, an alarm clock plug, or the like, thereby avoiding unsightly plugs or cords outside of the furniture housing 610. The electric outlets may include surge protectors (not shown). The electric outlets may be supplied with electric power from a cord-retractor 130' (shown in FIG. 3), which may be located, for example, under the bottom of the furniture housing 610, the back of the furniture housing 610, or in the cavity 650. The housing 610 may include an opening that allows the power cord 120 (shown in FIG. 3) to pass therethrough.

The panel 670 may include, for example, built-in units (shown in 11) for eye glasses, a magazine, a book, keys, a wallet, a purse, a cell phone, an iPod, an iPad, or the like. The built-in units may be provided on the side of the panel 670 facing the cavity 650 when the panel 670 is closed. The panel 670 may be configured to open and close manually or automatically under the control of the controller. In this regard, the casegood storage 600 may include an actuator (not shown) that operates under the control of the controller to move the panel 670 along the y-axis and/or x-axis, or that rotates the panel 670 about the y-axis or about the x-axis. The casegood storage 600 may include a further actuator (not shown) that operates under the controller of the controller to open and close the drawers 660.

The drawers 660 may be constructed from, for example, a clear injected molded plastic, a safety glass, or the like. Each drawer 660 may include different types of dividers (not shown) to keep articles (for example, clothing, documents, accessories, or the like) neatly organized, visible and readily accessible. The drawers 660 may be mounted to the furniture housing 610 via, for example, side-extension drawer glides.

Figure 11:
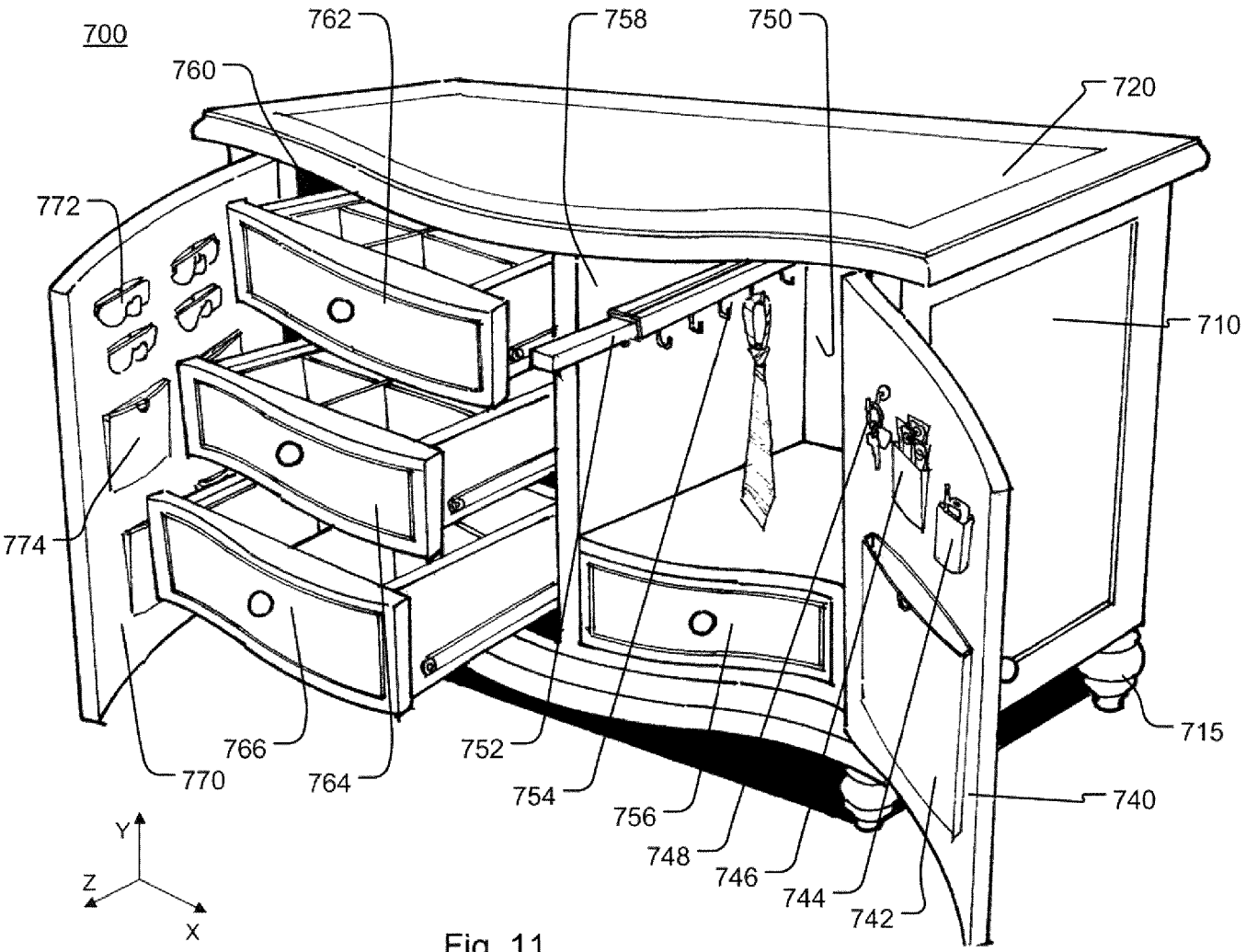
FIG. 11 shows another example of a casegood storage, constructed according to principles of the disclosure.

FIG. 11 shows another example of a casegood storage 700, which is constructed according to principles of the disclosure. The casegood storage 700 includes a furniture housing 710 and panels 740, 770. The furniture housing 710 may include a bottom, a plurality of walls and a top. The furniture housing 710 may further include one or more dividers 758. A plurality of legs 715 may be attached to, or integrally formed with the bottom of the furniture housing 710. An insert 720 may be provided on the top of the furniture housing 710. The insert 720 may include, for example, a panel made from glass, metal, rubber, leather, plastic, paper, cloth, or the like.

The furniture housing 710, including the divider 758, defines a pair of storage cavities 750, 760, which may include one or more drawers 756, 762, 764, and 766. The furniture housing 710 may further include one or more extension rods 752 for holding, for example, neck ties, belts, scarves, or the like. The extension rods 752 may include a plurality of hooks 754. The storage cavities 750, 760 may be enclosed by the panels 740, 770, respectively.

The furniture housing 710 may include one or more electric outlets (not shown) in the cavity 750 (and/or 760) to accommodate a cell phone charger, an iPod charger, an alarm clock plug, or the like, avoiding unsightly plugs or cords outside of the furniture housing 710. The electric outlets may include surge protectors (not shown). The electric outlets may be supplied with electric power from a cord-retractor 130' (shown in FIG. 3), which may be located, for example, under the bottom of the furniture housing 710, the back of the furniture housing 710, or in one or more of the storage cavities 750, 760. The housing 710 may include an opening that allows the power cord 120 (shown in FIG. 3) to pass therethrough.

The panels 740, 770 may include built-in units, including an eye glass unit 772, magazine unit 774, an iPad unit 742, a cell phone unit 744, a wallet unit 746, a key unit 748, and the like. The panels 740, 770 may be configured to open and close manually or automatically under the control of the controller. In this regard, the casegood storage 700 may include an actuator (not shown) that operates under the control of the controller to move the panels 740, 770 along the y-axis and/or x-axis, or that rotates the panels 740, 770 about the y-axis or about the x-axis. The casegood storage 700 may include a further actuator (not shown) that operates under the controller of the controller to open and close the drawers 756, 762, 764, and/or 766.

The drawers 756, 762, 764, and 766 may be constructed from, for example, a clear injected molded plastic, a safety glass, or the like. The drawers 756, 762, 764, and 766 may include different types of dividers to keep articles (for example, clothing, documents, accessories, or the like) neatly organized, visible and readily accessible. The drawers 756, 762, 764, and 766 may be mounted to the furniture housing 710 and/or the divider 758 via, for example, side-extension drawer glides.

Figure 12:
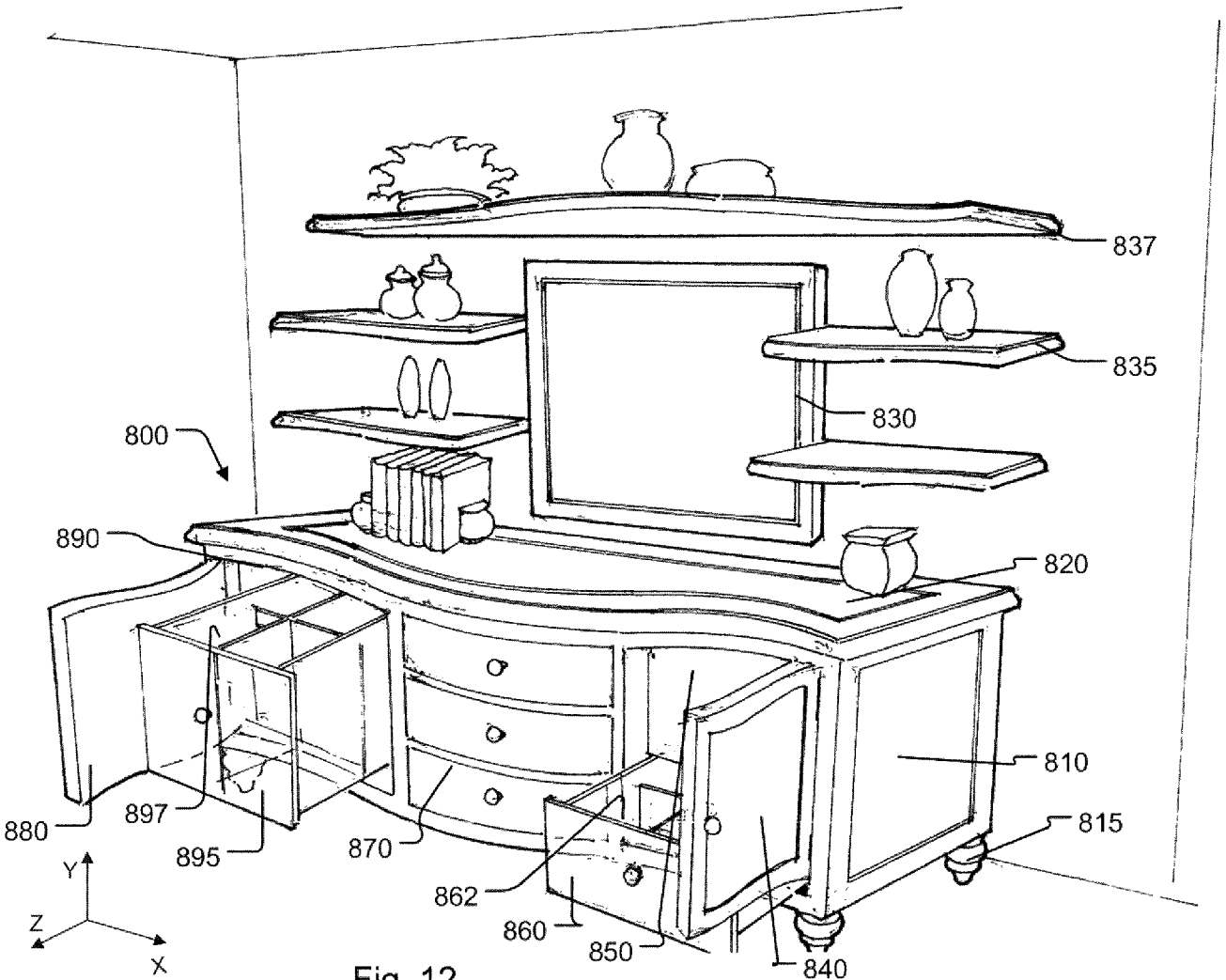
FIG. 12 shows yet another example of a case good storage, constructed according to principles of the disclosure.

FIG. 12 shows yet another example of a case good storage 800, which is constructed according to the principles of the disclosure. The casegood storage 800 includes a furniture housing 810, a pair of panels 840, 880, and a plurality of external drawers 870. The casegood storage 800 may further include a mirror 830 and a plurality of shelves 835, 837. The mirror 830 may include, for example, soft lighting. The furniture housing 810 may include a bottom, a plurality of walls and a top. A plurality of legs 815 may be attached to, or integrally formed with the bottom of the furniture housing 810. An insert 820 may be provided on the top of the furniture housing 810. The insert 820 may include, for example, a panel made from glass, metal, rubber, leather, plastic, paper, cloth, or the like.

The furniture housing 810 defines a plurality of storage cavities 850, 890, which may include one or more drawers 860, 895. The storage cavities 850, 890 may be enclosed by the panels 840, 880, respectively.

The furniture housing 810 may include one or more electric outlets (not shown) in one or both of the cavities 850, 890, or in any one or more of the drawers 860, 870, 895. The electric outlets may include surge protectors (not shown). The electric outlets may be supplied with electric power from a cord-retractor 130' (shown in FIG. 3), which may be located, for example, under the bottom of the furniture housing 810, the back of the furniture housing 810, in one or both of the cavities 850, 890, or on (or in) one or more of the drawers 860, 870, 895. The housing 810 may include an opening that allows the power cord 120 (shown in FIG. 3) to pass therethrough.

The panels 840, 880 may include, for example, built-in units (shown in FIG. 11) for eye glasses, a magazine, a book, keys, a wallet, a purse, a cell phone, an iPod, an iPad, or the like. The built-in units may be provided on the side of the panels 840, 880 facing the cavities 850, 890, respectively, when the panels 840, 870 are closed. The panels 840, 870 may be configured to open and close manually or automatically under the control of the controller. In this regard, the casegood storage 800 may include actuators (not shown) that operate under the control of the controller to move the panels 840, 870 along the y-axis and/or x-axis, or that rotate the panels 840, 870 about the y-axis or about the x-axis. The casegood storage 800 may include further actuators (not shown) that operate under the control of the controller to open and close the drawers 860, 870, 895.

The drawers 860, 895 may be constructed from, for example, a clear injected molded plastic, a safety glass, or the like. Each drawer 860, 895 may include different types of dividers to keep articles (for example, clothing, documents, accessories, or the like) neatly organized, visible and readily accessible. The drawers 860, 870, 895 may be mounted to the furniture housing 810 via, for example, side-extension drawer glides.

In a smart house application, a central controller (not shown) may be provided that is configured to remotely control any one or more of the lamp 100, the WMTV storage 200, the WMEE storage 300, the BT storage 400, the HA storage 500, or the casegood storages 600, 700, 800. The central controller may comprise a display (not shown), a computer (not shown), a user interface (not shown) and a transceiver (not shown), which may be configured to communicate over a communication link with a corresponding transceiver (not shown) provided in the lamp 100, the WMTV storage 200, the WMEE storage 300, the BT storage 400, the HA storage 500, or the casegood storages 600, 700, 800. The central controller may be linked to a network (not shown). Similarly, one or more of the lamp 100, the WMTV storage 200, the WMEE storage 300, the BT storage 400, the HA storage 500, or the casegood storages 600, 700, 800 may be linked to the network for remote control.

It is noted that the central controller, or any of the controllers located in the WMTV storage 200, the WMEE storage 300, the BT storage 400, the HA storage 500, or the casegood storages 600, 700, 800, may be voice activated and/or voice controlled.

While the disclosure has been described in terms of exemplary embodiments, those skilled in the art will recognize that the disclosure can be practiced with modifications in the spirit and scope of the appended claims. These examples given above are merely illustrative and are not meant to be an exhaustive list of all possible designs, embodiments, applications or modifications of the disclosure.

What is claimed:

1. A wall-mount flat screen television storage having a housing that defines a cavity for holding a flat screen television, the storage comprising:

a wall insert portion that is configured to be placed in a building wall;

a frame portion that is configured to rest against a surface of the building wall;

a plurality of panels that is configured to open away from one another and configured to enclose the cavity and substantially entirely conceal an interior of the cavity; and a controller to operate the plurality of panels and wherein the controller is voice controlled, wherein the panel is further configured to receive and hold a decorative feature.

2. The storage according to claim 1, the storage further comprising:

a television mount bracket that holds the television.

3. A furniture article, comprising:

a furniture housing that is configured to rest on a surface;

a panel that encloses a cavity defined by the furniture housing, wherein the panel is configured to be opened or closed, wherein the cavity comprises at least one of:

an eye glass unit that is configured to receive eye glasses;

a magazine unit that is configured to receive a magazine or a document;

a cell phone unit that is configured to receive a cell phone;

a wallet unit that is configured to receive a wallet; and a key unit that is configured to receive a set of keys;

at least one controller that operates to rotate at least one panel, wherein the controller is voice controlled; and a clear injection molded drawer or divider that is located in the furniture housing and substantially concealed by the panel when the panel is in a closed position.

4. The furniture article according to claim 3, further comprising a mirror.

5. The furniture article according to claim 4, wherein the mirror comprises a soft light.

6. The furniture article of claim 3, the furniture article further comprising:

at least one controller that operates an actuator to automatically move at least one panel.

* * * * *